United States Patent [19]

Mula

[11] Patent Number: 5,016,151

[45] Date of Patent: May 14, 1991

[54] HIGH-INTENSITY UNDERWATER LIGHT SOURCE

[75] Inventor: Richard Mula, Oakland, Calif.

[73] Assignee: Hydroimage, Los Angeles, Calif.

[21] Appl. No.: 354,981

[22] Filed: May 17, 1989

[51] Int. Cl.[5] ..... F21V 31/00

[52] U.S. Cl. ..... 362/267; 362/158; 362/261; 362/254

[58] Field of Search ..... 362/158, 261, 267, 294, 362/362, 3, 8, 9

[56] References Cited

U.S. PATENT DOCUMENTS

| | | | |
|---|---|---|---|
| 3,852,587 | 12/1974 | Koehler | 362/158 |
| 4,069,415 | 1/1978 | Dacal | 362/267 |
| 4,075,530 | 2/1978 | Furukubo et al. | 313/229 |
| 4,135,228 | 1/1979 | Lones | 362/18 |
| 4,259,710 | 3/1981 | Schlack | 362/267 |
| 4,419,716 | 12/1983 | Koo | 362/158 |
| 4,556,933 | 12/1985 | Mendoza | 362/267 |
| 4,574,337 | 3/1986 | Poppenheimer | 362/267 |
| 4,598,346 | 7/1986 | Bodde | 362/267 |
| 4,617,615 | 12/1986 | Eychaner | 362/216 |
| 4,661,893 | 4/1987 | Robinson et al. | 362/267 |
| 4,683,523 | 7/1987 | Olsson et al. | 362/267 |
| 4,689,523 | 8/1987 | Fowler | 315/76 |
| 4,764,334 | 8/1988 | King et al. | 376/248 |

FOREIGN PATENT DOCUMENTS

| | | | |
|---|---|---|---|
| 0017638 | 10/1980 | European Pat. Off. | 362/158 |
| 2174182 | 10/1986 | United Kingdom | 362/158 |

OTHER PUBLICATIONS

Burgner, LD&A vol. 19/No. 10, "Lighting the Abyss", 10/89.

Product Brochure "Hail Columbia!" and The Deepie, Birns Oceanographic, Inc. Date Prior to 1984 (3 Pages).

Product Brochure "1000 Watt Quartz Iodide Lamp Model LQ1000" Hydro Products, Date Believed to be 1982 (1 Page).

Lamp Product Brochure "The Close Reflector and Why Better", Birns & Sawyer, Inc. (3 Pages), No Date.

Product Brochure "BriteAcr & BriteBeam", Sylvania Corp., Date Believed to be 1984, (12 Pages).

*Primary Examiner*—Ira S. Lazarus
*Assistant Examiner*—Richard R. Cole
*Attorney, Agent, or Firm*—Gregory Garmong

[57] ABSTRACT

An underwater light source includes a sealed beam arc lamp within a wrought and machined, generally cylindrical aluminum housing. The watertight housing has an enlarged diameter at one end to receive the lamp and tapers to a smaller diameter at the other end, which receives the ignitor for the lamp. The larger end is covered with a heat resistant cover glass, and the smaller end is closed. A cylindrical accessory mounting ring is attached to the front end of the housing, and the ring has ventilation openings therein to release heat generated by the lamp.

13 Claims, 3 Drawing Sheets

HIGH-INTENSITY UNDERWATER LIGHT SOURCE

BACKGROUND OF THE INVENTION

This invention relates to light sources for use underwater, and, more particularly, to a compact high intensity light source particularly useful in the motion picture industry.

When motion pictures are filmed, the director often calls for artificial lighting in scenes, beyond that available from ambient natural lighting. The artificial light may be utilized to increase the general level of illumination so that slower speed film can be used, to highlight particular features, to illuminate otherwise darkened areas, or for other purposes. Important requirements of such lighting are that it be of sufficient intensity, that it be of the form needed, such as a narrow spot or broad flood of light, that it be conveniently provided, and that it be of a natural coloration so that the colors of the scene are not distorted.

Underwater movies have grown in popularity in recent years, and scenes filmed underwater pose some particular problems for cameramen and lighting engineers. The available ambient light level decreases with increasing depth and there is often little illumination of features on the bottoms of objects, so that artificial lighting is utilized in nearly all scenes.

Underwater lighting sources have the same requirements of intensity, form, convenience and coloration as lighting sources used out of water, but the ability to meet these requirements is made difficult by some of the technical limitations of the light sources. One approach to underwater lighting has been to plunge conventional lamps available in the industry, but connected to their power sources by rubber potted cables, directly into the water. This approach continues to be used, but is not fully satisfactory for several reasons. The halogen cycle lamps often used are cooled too strongly, and may never be able to reach their proper operating temperature of 485° F. The result is color deviation in the film and reduced operating life of the lamp. Because the water attenuates the light from the lamp, a generally higher intensity, more powerful lamp is required underwater than for an otherwise equivalent above-water scene. The lamps often burn out after short times or a few on-off cycles, primarily due to the boiling of water in contact with the glass envelope of the lamp that tends to crack the glass. Powerful lamps are large in size and unwieldy. They are heavy and difficult to place and move, a major inconvenience because such work must be done by divers. The glass envelopes of incandescent lamps are not made to resist the high pressures found at depths greater than about 150 feet.

In another approach, small or medium size incandescent or halogen cycle lamps have been placed into watertight housings and operated underwater. In most cases, the lamps are not sufficiently powerful for use in underwater filming, or, if sufficiently powerful, are extremely large in size.

Accordingly, there is a need for an improved underwater lighting source for the motion picture industry. The present invention fulfills this need, and further provides related advantages.

SUMMARY OF THE INVENTION

The present invention provides a high-intensity underwater lighting source that is light in weight, compact, and easy to manipulate. It has a long life of a thousand hours or more, and can be turned on and off underwater repeatedly without damage. Different types of lamps can be used, and in particular a 5600K color temperature lamp that simulates the color spectrum of sunlight is available. Conventional accessories are easily used with the light source, which can thereby provide narrow beam illumination, flood illumination, or filtered or colored illumination. The light source of the invention provides movie directors, cameramen, and lighting engineers the same type of capability, flexibility, and convenience in underwater lighting that they have available in above-water lighting.

In accordance with the invention, an underwater light source comprises a sealed beam parabolic aluminized reflector arc lamp and the ignitor unit for the lamp; a watertight housing for the arc lamp and ignitor unit, the housing including a generally cylindrical shell that receives the arc lamp and ignitor unit therein, the shell being made of a wrought and machined aluminum alloy and having a first diameter at the front end sufficiently large to receive the arc lamp therein, a second diameter at the back end sufficiently large to receive the ignitor therein, the second diameter being smaller than the first diameter, and a transition region wherein the diameter is reduced from the first diameter to the second diameter, a heat resistant cover glass over the end of the shell having the first diameter, and mountings for the arc lamp and the ignitor unit, so that the arc lamp faces toward the front of the shell; and an insulator within the shell housing between the arc lamp and the ignitor positioned to reduce heat flow from the lamp to the ignitor when the lamp is in operation.

More generally, an underwater light source comprises a sealed beam lamp; a lamp shell sealed against leakage of water and made of wrought and machined aluminum, the shell being sufficiently large to receive the lamp therein; a retainer that holds the lamp in place within the lamp shell; a heat resistant glass cover on the front end of the lamp shell; an ignitor connected to the lamp; and an ignitor shell sealed against leakage of water, the ignitor shell being sufficiently large to receive the ignitor therein.

The present light source preferably utilizes a commercially available sealed beam metal halide lamp often referred to as an HMI (Hydrargyrum Medium arc Iodide) lamp, which is available in a variety of power levels and light outputs. The use of a commercial lamp, as distinct from a custom-made lamp, has the advantages of optimization of the lamp by the manufacturer, low cost, and easy replaceability.

Such arc lamps produce a high heat flux as a byproduct of the light output, and perhaps the most challenging aspect of their use underwater is dissipating the heat without damaging the lamp, the housing shell, and the ignitor that produces the high voltage required to strike the arc, while permitting the use of accessories. The present housing is constructed of a wrought aluminum alloy, preferably the alloy 6061-T651. Such wrought alloys have significantly higher strengths than do cast alloys. The aluminum alloy can be made thinner, which increases heat dissipation through the housing wall. Heat conduction through the interior volume of the housing can damage the ignitor, unless it is properly thermally insulated. A mass of ceramic wool has been found to be a sufficient insulation.

Another feature of the invention is an accessory holder that is supported on the front of the housing. The accessory holder is formed as a ring that is generally continuous with the shell of the housing, but is attached to the housing as a separate piece. The accessory holder has ventilation openings therethrough, to permit hot water and bubbles produced at the front of the lamp to escape. Without such openings, the high heat production results in boiling of water in the light path, which reduces and/or distorts the light of the lamp. Accessories are readily and replaceably held by the holder ring in the light beam but spaced apart from the glass cover, so that they are not damaged by the heat.

The present invention therefore provides an important advance in the art of underwater lighting, particularly for the filming of motion pictures but also for other underwater lighting needs such as salvage work. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENTS

Figure 1:
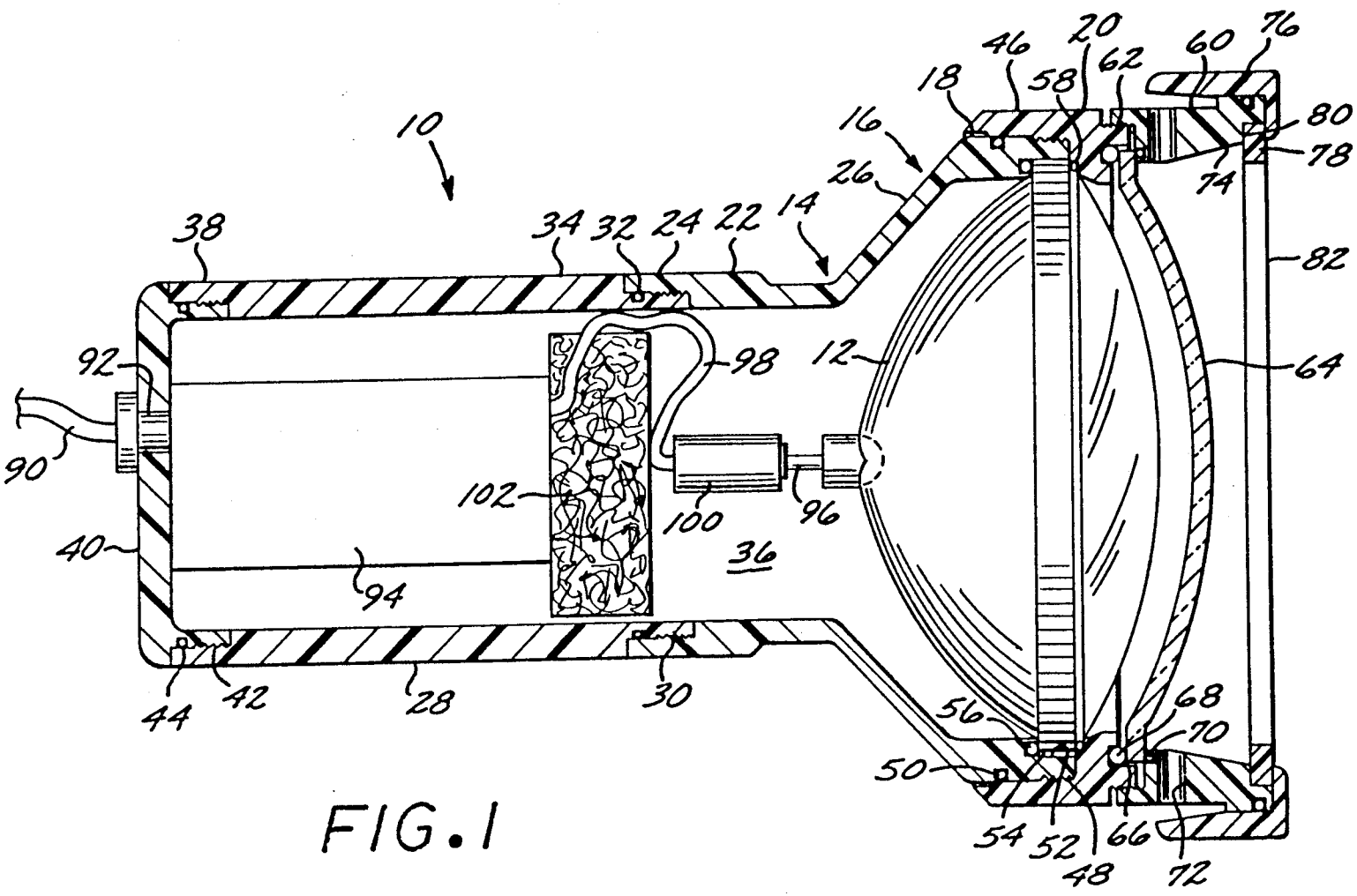
FIG. 1 is a side sectional view of an underwater light source.

In accordance with the invention, an underwater lamp housing suitable for use with a sealed beam arc lamp requiring an ignitor unit comprises a lamp shell having a generally cylindrical shape with at least two cylindrical diameters thereon and made of wrought and machined aluminum, the shell having a first diameter at a front end thereof that is sufficiently large to receive the lamp head, a second diameter less than the first diameter at a back end thereof, and a diametral transition between the first diameter and the second diameter; a retainer that holds the lamp in place within the shell; a heat resistant glass cover on the front end of the shell; a generally cylindrical accessory holder ring of about the first diameter, attached to the front end of the lamp shell, the accessory holder having cooling ventilation openings in the sides thereof; an ignitor shell having a generally cylindrical shape and attached to the back end of the shell in a cylindrically symmetric fashion, the ignitor shell having an ignitor shell diameter sufficiently large to receive the ignitor therein and equal to the second diameter of the lamp shell to form a continuous cylindrical shape therewith, the ignitor housing further having an open front end and a closed back end, the open front end of the ignitor housing and the open back end of the lamp shell cooperating to form a continuous interior volume that receives the lamp and ignitor unit therein; and a mass of ceramic wool insulator in the interior volume between the lamp station and the ignitor station.

The invention is embodied in an underwater light source 10, illustrated in a preferred embodiment utilizing a 1200 watt sealed beam HMI medium arc length metal halide lamp 12. The underwater light source 10 includes a generally cylindrical housing 14 having two primary, generally cylindrical, structural subhousings. As used herein, a "generally cylindrical" article is one that has a cylindrical axis of symmetry, but not necessarily of a constant cylindrical diameter.

One of the subhousings is a generally cylindrical lamp shell 16 that has a cylindrical axis of symmetry, but has a first cylindrical diameter 18 near a front end 20 of the lamp shell 16 (which is also the front end of the entire light source 10), a second cylindrical diameter 22 near a back end 24 of the lamp shell 16, and a diametral transition region 26 between the regions of the diameters 18 and 22.

The second subhousing is a generally cylindrical ignitor shell 28 that has a single cylindrical diameter. The diameter of the ignitor shell 28 is the same as the second cylindrical diameter 22 of the lamp shell 16. A threaded engagement 30, with a circumferential O-ring 32, allows the ignitor shell 28 to be removably joined to the lamp shell 16 with a watertight seal. The joint between the two shells is smooth to the touch and comfortable to hold. In the preferred approach utilizing a 1200 watt lamp, the second cylindrical diameter is 5.25 inches, so that the light source 10 can be held in the manner of a flashlight by the ignitor shell 28.

A front end 34 of the ignitor shell 28 is open, as is the back end 24 of the lamp shell 16, thereby forming a continuous interior volume 36. A back end 38 of the ignitor shell, which is also the back end of the light source 10, is closed, either integrally or, preferably, with a plug 40. The plug 40 is removably joined with a watertight seal to the ignitor shell 28 using a threaded engagement 42 and O-ring 44.

At the front end of the 20 of the lamp shell 16, a lamp retainer ring 46 is joined with a watertight seal to the lamp shell 16, using an external threaded engagement 48 and O-ring 50. The lamp shell 16 has a recess 52 extending around the interior of the circumference, adjacent to the engaged position of the retainer ring 46. A lip 54 in the glass enclosure of a sealed beam lamp 56 is retained in the recess 52 by the retainer ring 46 as it is screwed down into place. Preferably, an O-ring 56 is placed in the recess 52 so that the retainer ring 46 tightens the lamp 12 against the O-ring 56, forming a further seal and also reducing the likelihood of cracking the glass of the lamp as the ring is tightened. A second O-ring 58 is placed between the retainer ring 46 and the lip 54 of the lamp 56, also assisting in forming a seal and reducing the likelihood of cracking the glass of the lamp 12. The O-rings 56 and 58 are preferably made of high temperature silicone or teflon, to withstand the heat produced by the lamp 12.

An accessory ring 60 is removably joined by a threaded engagement 62 to the forwardly extending end of the retainer ring 46. This engagement is not watertight. A heat resistant cover glass 64 is captured between the retainer ring 46 and the accessory ring 60, in a recess 66 on the forwardly extending end of the retainer ring 46. The greatest depth at which the light source 10 may be used is determined by the thickness of the cover glass 64. For example, a $\frac{1}{4}$ inch thick cover glass may be used to a depth of 300 feet. An O-ring 68 between the cover glass 64 and the retainer ring 46 provides a watertight seal at that point, and cushions the cover glass 64 to reduce the likelihood of its cracking during assembly. Another O-ring 70 is placed between the accessory ring 60 and the front side of the cover glass 64, also to cushion and prevent cracking of the cover glass as the accessory ring 60 is tightened down on its engagement 62. The O-rings 68 and 70 are also preferably made of silicone or teflon.

The accessory ring 60 has a plurality of openings 72 therethrough, around the circumference of the ring 46. When the lamp 12 operates, the cover glass 64 is heated by conduction and absorbed energy from the light beam. This heat can be so intense that, even for a 1200 watt lamp, the water immediately adjacent the cover glass 64 is heated to the boiling point. If so, and water vapor bubbles form, these bubbles can collect in the space in front of the cover glass 64 and block the beam or even be imaged in the illuminated scene. The openings 72 permit hot water and bubbles, if any, to escape from the light source 10, whatever its orientation in the water.

On the front end 74 of the accessory ring 60 is an accessory retainer ring 76, which is engaged to the accessory ring 60 by threads, friction, or a spring/snap action. The ring 76 preferably extends sufficiently far rearwardly to block light beams that would pass out through the openings 72. The retainer ring 76 holds an accessory mount 78 in place within a recess 80 in the front end 74 of the accessory ring 60. The accessory mount 78 receives an accessory in the form of a beam altering element 82, such as a filter, gel, or snoot, onto the front of the light source 10, in a position that the beam of light produced by the light source is intercepted by the beam altering element 82. Thus, accessories are held in the beam path in a manner in which they can be readily and quickly changed by releasing the ring 76, removing the accessory, and replacing it with another accessory. The accessories are separated from the heat of the lamp 12 by a layer of water within the interior of the accessory ring 60, and are cooled by the water on the outside of the light source 10. Thus the accessories remain cool and are not likely to be damaged.

Power for the lamp 12 is furnished through a power cord 90, that is plugged into an underwater matable connector 92 on the back end 38 of the ignitor shell 28. Such an underwater connector 92 is available commercially from Brantner & Associates, Inc., San Diego, Calif. The power is provided to a solid state AC/DC ignitor 94 that is contained in the portion of the volume 36 that is within the ignitor shell 28.

In the case of the preferred 1200 watt lamp 12, the nominal operating voltage is 110 volts and the current is 13 amps after the arc is struck and steady state is achieved. To strike the arc, a voltage of 17,000–45,000 volts is required. The ignitor 94 supplies the required voltage as a function of time. Such an ignitor 94 is available commercially from DN Laboratories, San Diego, Calif.

Power is conducted from the ignitor 94 to electrodes 96 projecting from the back of the lamp 12, by an electrical conductor 98 including a copper high tension wire insulated by silicone insulation to resist breakdown at the maximum ignition voltage of 45,000 volts. The conductor 98 is connected to the electrodes 96 with a connector 100, whose construction will be discussed in greater detail below.

A mass of ceramic wool insulator 102 is placed within the volume 36 between the ignitor 94 and the lamp 12. The insulator 102 prevents damage to the ignitor 94 by heat conducted from the lamp 12. In the absence of the ceramic wool insulator or an equivalent insulating material, the heat reaching the ignitor 94 is so large that the solder connections inside the ignitor 94 may melt, or at the least components may be damaged, during extended operation of the light source 10. For the preferred embodiment utilizing a 1200 watt HMI lamp 12, the ceramic wool insulator is about 2 inches thick.

The ceramic wool is a needle-felted blanket of synthetic alumina-silica inorganic fibers. The fiber diameter is about 2.8 micrometers, the fiber length is 4–10 inches, the fiber specific gravity is 2.56, and the fiber melting point is 3200° F. The density of the ceramic wool is 8 pounds per cubic foot, and the thermal conductivity is 0.5 BTU·inch/hour·square foot/° F., as measured according to ASTM Specification C201. It is available commercially from Babcock & Wilcox as Kaowool®.

The lamp shell 16, and preferably the ignitor shell 28, are machined from wrought aluminum stock such as rolled or extruded aluminum bar. The preferred bar stock is 6061 aluminum in the T651 condition. The use of wrought bar provides a sufficiently high strength for the material of the lamp shell 16 that it may be made as thin as 3/16–¼inch in the area of the diametral transition 26. The use of a thin metal housing is important, as the heat produced by the lamp 12 may be readily removed by the water surrounding the outside of the shell 16. The strong wrought aluminum alloy also permits the entire housing 14 to be made light in weight, an important advantage. By contrast, use of a cast housing would require a greater thickness of metal and greater total weight.

Figure 2:
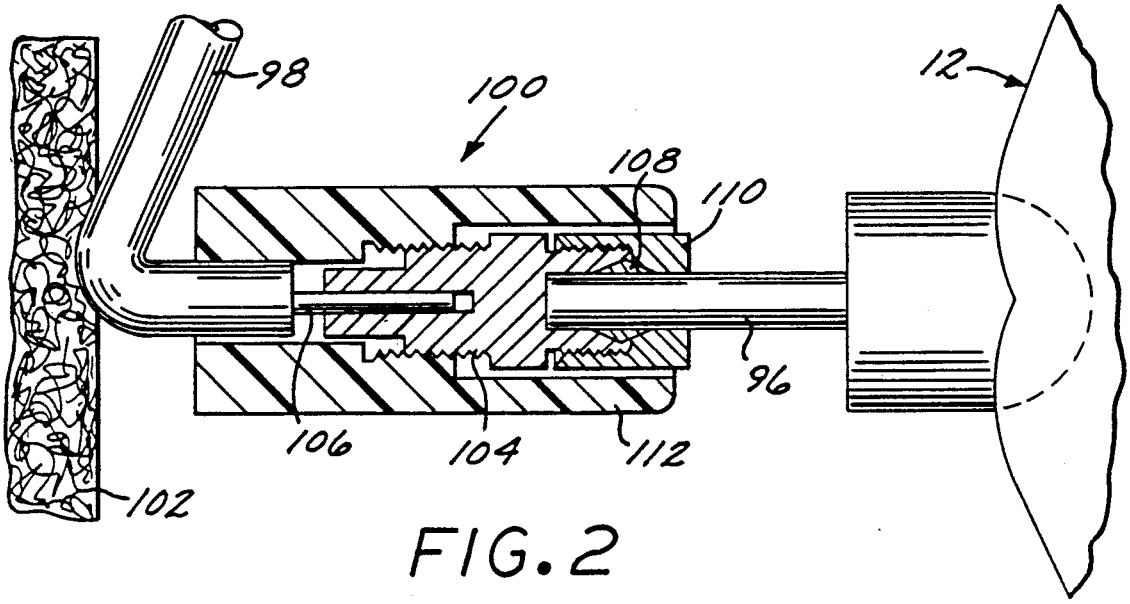
FIG. 2 is an enlargement of a detail of FIG. 1, illustrating the connector that extends between the ignitor and the lamp.

One of the two connectors 100 is illustrated in greater detail in FIG. 2. The connector 100 includes a body 104 that receives, at one end, a copper wire 106 of the electrical conductor 98. (The insulation of the conductor 98 is silicone insulation to withstand the heat produced by the lamp 12 and to insulate the maximum 45,000 volts provided to the lamp by the ignitor. For the preferred 1200 watt HMI lamp, the silicone insulation is about 0.100–0.120 inches thick, over a 0.050 inch diameter copper wire.) The body 104 is crimped or swaged over the wire 106 to form a strong mechanical bond. At the other end, the body 104 receives the electrodes 98 of the lamp 12. A ferrule 108 and nut 110 are placed over each electrode 98 before it is assembled into the body 104, and after insertion the nut is tightened to threads on the body 104. A polytetrafluoroethylene (teflon) insulator 112 is threadably engaged over the body 104, to prevent arcing to the adjacent connector when the 45,000 volt maximum ignition voltage is applied.

Figure 3:
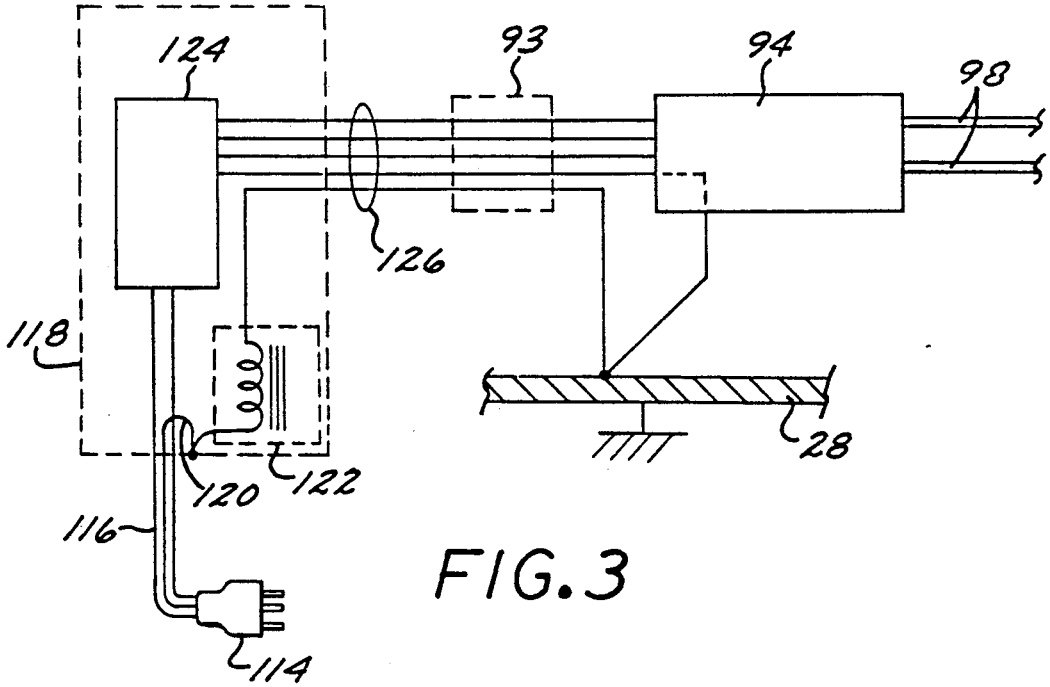
FIG. 3 is a schematic diagram of the electrical system for the light source of FIG. 1.

The electrical supply circuitry for the light source 10 is illustrated in FIG. 3. Since the light source 10 is operated underwater and high voltages and currents are required, particular care is taken to avoid possible damage or injury resulting from an electrical malfunction. Power for the light source 10 is supplied from an external source (not shown), such as a wall plug or generator, through a ground fault interruptor circuit (GFIC) plug 114 and a grounded cable 116. The GFIC plug measures the current flowing in the ground line. If it is greater than 5 milliamps for a period of more than 1/60 of an AC cycle, power is disconnected until the problem is resolved. Such a plug is available from Pass and Seymour Co, New York City.

A ballast unit 118 is above water, in a studio or on a boat. The cable 116 is grounded to the case of the ballast unit 118 through a ground wire 120. The ground wire 120 is further connected to an additional ground fault interrupter circuit 122. A ground circuit is formed through the light source 10 in the manner to be described, so that a break in the ground anywhere in the system will cause power to the light source 10 to be interrupted.

The ballast unit 118 includes either a solid state switching power supply 124 or a standard reactor ballast that provides a 120 volt AC to square wave ballast. A ballast unit 118 performing this function is available commercially from DN Laboratories, San Diego, Calif.

Extending from the ballast unit 118 to the light source 10 is an underwater cable 126 having five conductors. Two of the conductors are the hot and neutral conductors that conduct the primary power to the ignitor 94. Another conductor is a control line that may be used to turn the light source 10 on and off remotely. A fourth conductor 128 is a ground to the ignitor 94 from the power supply 124. A fifth conductor 130 is a ground return connected to the ground fault interrupter circuit 122 at one end, and to the ignitor shell 28 and thence to the ignitor 94 at the other. The ground 128 and the ground return 130 form a circuit that, if broken, causes power to the light source 10 to be immediately interrupted until the ground is restored.

A light source as shown in FIG. 1 has been constructed and operated extensively underwater. The lamp is a BB 1200 watt HMI lamp manufactured by Sylvania, which has a color temperature of 5600K. This color temperature is comparable to sunlight, so that the motion pictures made with this illumination have a true color appearance. The power consumption is 13 amperes at a nominal 110 volts AC. This power is readily provided through a power cord similar to that of a household extension cord. The shells are machined from 6061-T651 aluminum bar. The maximum diameter of the lamp shell is 10.5 inches, the diameter of the ignitor shell is 5.25 inches, the overall length of the light source is 18 inches, and the thickness of aluminum in the diametral transition region is 0.25 inch. The light source weighs 27 pounds in air and 4 pounds in water. The light source has a life of over 1000 hours in water. When the light source is operated as a flood lamp, at 50 feet distance the diameter of the beam is 50 feet, and the light intensity is 80 foot-candles.

To achieve a comparable light output with a conventional incandescent lamp, as in the prior approach to underwater lighting, the light source must be a 10,000 watt incandescent lamp. Power consumption is 85 amperes at 120 volts, requiring welding cable to conduct the power and much more extensive safety precautions than required for the HMI lamp. The light source is about 24 inches in diameter, 28 inches long, and weighs 127 pounds out of water. The light source has a typical operating life of at most about 150 hours before failure. When this light source is operated as a flood lamp, at 50 feet distance the beam is 50 feet in diameter and has an intensity of 70 foot-candles.

As may be seen from the preceding two paragraphs, the light source of the invention provides advantages in virtually every respect, as compared with the prior approach. These advantages have been emphasized in relation to a 1200 watt light source, but similar advantages are achieved for light sources of other sizes.

The light source of FIG. 1 utilizes a power supply that is above water and a cable running down through the water to the light source. The ignitor and the lamp are in a single integrated unit. Other approaches are possible using the present invention, and two of these are illustrated in FIGS. 4 and 5.

Figure 4:
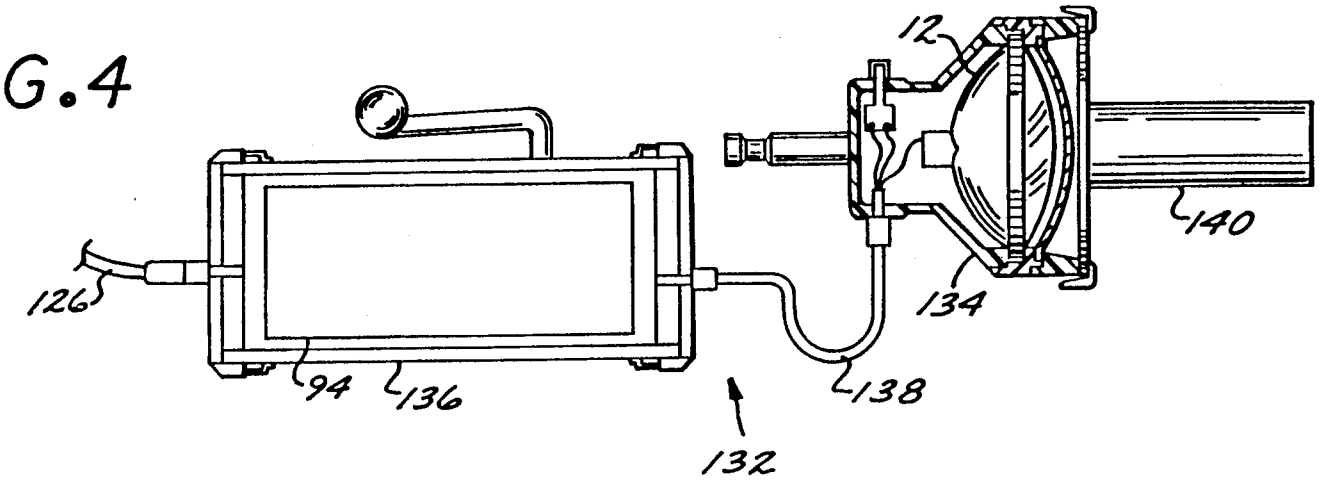
FIG. 4 is a side sectional view of a self-contained underwater light source.

Referring to FIG. 4, a light source 132 is similar to the light source 10 in that it receives power from the surface through the cable 126. It differs in having the lamp 12 mounted in a lamp housing 134 separated from an ignitor housing 136 that contains the ignitor 94. The construction of the housings 134 and 136 is like that described in respect to the embodiment of FIG. 1, and will not be repeated. A cable 138 extends between the housings 134 and 136 to supply power to the lamp 12. The light source 132 can be used with large, medium, or small power lamps 12, and is particularly useful where the lighting needs require that the lamp housing 134 be placed into a small space or precisely mounted on a support that is not sufficiently strong to also mount the ignitor. (The light source 132 is illustrated with a snoot 140, which is a hollow cylinder mounted on the front of the source to reduce the broad beam from the lamp 12 to a narrow spot.)

Figure 5:
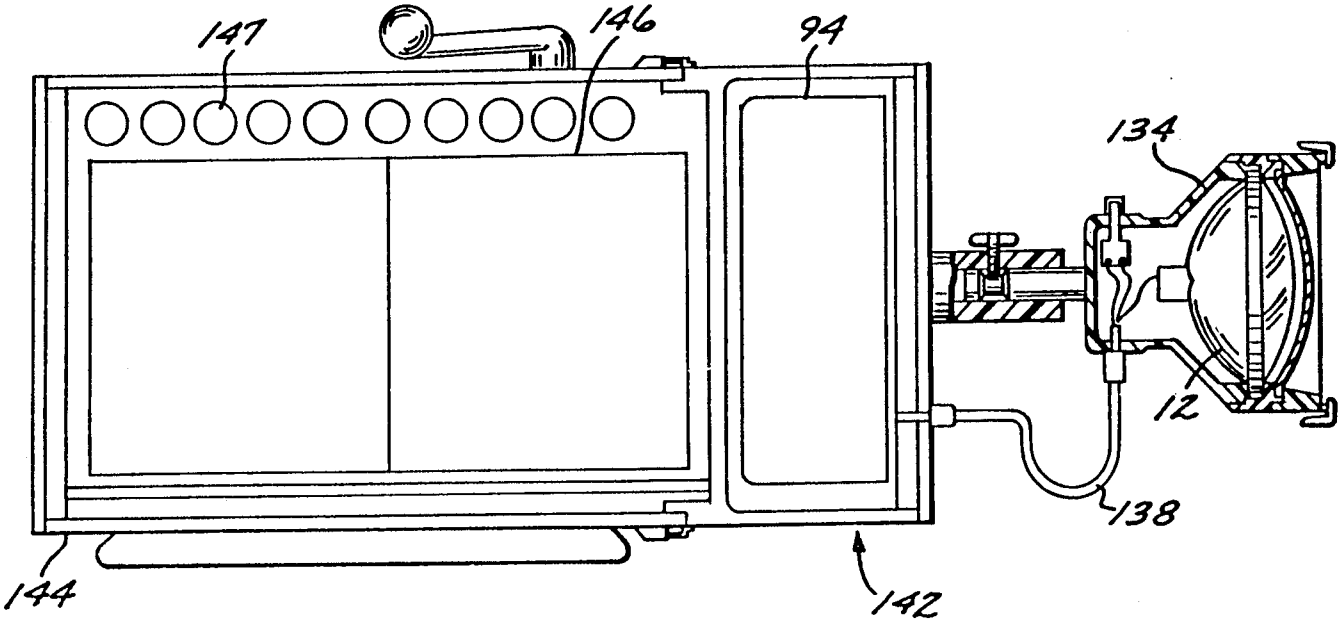
FIG. 5 is a side sectional view of an underwater light source with a separate ignitor unit.

Referring to FIG. 5, a light source 142 is a fully self contained unit that does not receive power from the surface. The diver/operator of the light source 142 can move about in the water without the need to pull the cable 126. In the light source 142, the lamp 12 is contained within the lamp housing 134 as a separate unit. A power housing 144 contains a battery 146 that supplies power to the ignitor 94, which in turn supplies power to the lamp 12 through the cable 138. The battery includes associated hydrogen/oxygen catalytic recombiner balls 147, to prevent accumulation of hydrogen in the sealed space. These balls catalyze the recombination of hydrogen and oxygen within the closed space, and are available as Catalyzers from Hydro-Cap, Inc. The lamp housing 134 is removably connected to the power housing 144 in the manner illustrated in FIG. 5, and may be removed and placed as necessary. However, the lamp housing 134 remains tethered to the power housing 144 by the cable 138. The size of the lamp 12 operable with the light source 142 is limited by the available energy stored in the battery 146. The largest lamps used in the light source 142 have been 200 watt lamps, which can be operated for 80–90 minutes using a battery having 12.5 ampere-hours capacity. This entire light source 142 weighs about 42 pounds out of water and has neutral buoyancy in water, so that the lighting operator can readily swim with it.

The approach of the invention provides an important advance in the art of underwater lighting. High intensity lighting, comparable with that used in above-water studios or outdoor scenes, can be provided in underwater film scenes. Different types of lamps can be used, but the use of an HMI lamp yields particularly high intensity, long life, safety, and the proper wavelength distribution for film making. Although particular embodiments of the invention have been described in detail for purposes of illustration, various modifications may be made without departing from the spirit and scope of the invention. Accordingly, the invention is not to be limited except as by the appended claims.

What is claimed is:

1. An underwater light source, comprising:

a sealed beam lamp;

a lamp shell sealed against leakage of water and made of machined aluminum, the shell having a front end and being sufficiently large to receive the lamp therein with the lamp positioned to direct its beam out of the front end of the lamp shell;

a retainer that holds the lamp in place within the lamp shell;

a heat resistant glass cover on the front end of the lamp shell;

an ignitor connected to the lamp;

an ignitor shell sealed against leakage of water, the ignitor shell being sufficiently large to receive the ignitor therein; and means for insulating the ignitor from the heat produced by the lamp during operation.

2. The light source of claim 1, further including an accessory holder ring attached to the front end of the lamp shell, the accessory holder having cooling ventilation openings in the sides thereof.

3. The light source of claim 1, wherein the lamp shell and the ignitor shell are connected together to form a continuous interior volume.

4. The light source of claim 3, wherein the means for insulating includes a mass of ceramic wool insulator in the interior volume between the lamp and the ignitor.

5. The light source of claim 1, wherein the lamp is a medium arc length halide lamp.

6. An underwater lamp housing suitable for use with a sealed beam arc lamp requiring an ignitor unit, comprising:

a lamp shell having a generally cylindrical shape with at least two cylindrical diameters thereon and made of machined aluminum, the shell having a first diameter at a front end thereof that is sufficiently large to receive a head of a sealed beam arc lamp, a second diameter less than the first diameter at a back end thereof, and a diametral transition between the first diameter and the second diameter, the back end of the lamp shell being open;

a retainer that holds the lamp in place within the shell;

a heat resistant glass cover on the front end of the lamp shell;

a generally cylindrical accessory holder ring of about the first diameter, attached to the front end of the lamp shell, the accessory holder having cooling ventilation openings in the sides thereof;

an ignitor shell having a generally cylindrical shape and attached to the back end of the shell in a cylindrically symmetric fashion, the ignitor housing having an ignitor housing diameter sufficiently large to receive the ignitor unit therein and equal to the second diameter of the lamp shell to form a continuous cylindrical shape therewith, the ignitor housing further having an open front end and a closed back end, the open front end of the ignitor shell and the open back end of the lamp shell cooperating to form a continuous interior volume that receives the lamp and ignitor unit therein; and a mass of ceramic wool insulator in the interior volume between the lamp station and the ignitor station.

7. The housing of claim 6, further including a medium arc length halide lamp contained within the lamp shell.

8. The housing of claim 6, further including an ignitor contained within the ignitor shell.

9. The housing of claim 6, further including:

a generally cylindrical accessory holder ring attached to the front end of the lamp shell, the accessory holder having cooling ventilation openings in a cylindrical wall thereof.

10. The housing of claim 6, wherein the shell is formed of two cylindrical sections joined together along the length of the shell.

11. An underwater light source, comprising:

a sealed beam parabolic aluminized reflector arc lamp and the ignitor unit for the lamp;

a watertight housing for the arc lamp and ignitor unit, the housing including a generally cylindrical shell that receives the arc lamp and ignitor unit therein and has a front end and a back end, the shell being made of a machined aluminum alloy and having a first diameter at the front end of the shell sufficiently large to receive the arc lamp therein, a second diameter at the back end of the shell sufficiently large to receive the ignitor unit therein, the second diameter being smaller than the first diameter, and a transition region wherein the diameter is reduced from the first diameter to the second diameter, a heat resistant cover glass over the front end of the shell having the first diameter, and mountings for the arc lamp and the ignitor unit, so that the arc lamp faces toward the front of the shell; and an insulator within the shell housing between the arc lamp and the ignitor positioned to reduce heat flow from the lamp to the ignitor when the lamp is in operation.

12. The light source of claim 11, further including:

a generally cylindrical accessory holder ring attached to the front end of the shell, the accessory holder having cooling ventilation openings in the sides thereof.

13. The light source of claim 11, wherein the shell is formed of two cylindrical sections joined together along the length of the shell.

* * * * *